US007131158B2

(12) United States Patent
Brown et al.

(10) Patent No.: US 7,131,158 B2
(45) Date of Patent: Nov. 7, 2006

(54) APPARATUS AND METHOD FOR FORMING MULTI-COLORED YARN

(75) Inventors: Robert S Brown, Spartanburg, SC (US); William Martin Pascoe, Inman, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/887,755

(22) Filed: Jul. 9, 2004

(65) Prior Publication Data

US 2004/0242102 A1 Dec. 2, 2004

Related U.S. Application Data

(62) Division of application No. 09/969,854, filed on Oct. 2, 2001, now abandoned.

(51) Int. Cl.
*D06B 11/00* (2006.01)

(52) U.S. Cl. ..... 8/149; 8/151.2; 8/483; 8/499

(58) Field of Classification Search ..... 8/149.1, 8/147, 483, 499, 151, 151.2, 149
See application file for complete search history.

(56) References Cited

U.S. PATENT DOCUMENTS 4,309,881 A * 1/1982 Kimble ..... 68/205 R
4,923,743 A * 5/1990 Stewart, Jr. ..... 427/288
5,016,308 A * 5/1991 McBride et al. ..... 8/149
5,211,339 A * 5/1993 Zeiler ..... 239/295
5,331,829 A * 7/1994 Zeiler ..... 68/205 R
5,367,733 A * 11/1994 Zeiler ..... 8/149.1
5,413,832 A 5/1995 Willey ..... 428/97
5,491,858 A 2/1996 Massottte et al. ..... 8/151.2
5,557,953 A 9/1996 Massottte et al. ..... 68/205 R
5,594,968 A 1/1997 Hasselwander et al. ..... 8/149
6,019,799 A * 2/2000 Brown et al. ..... 8/483
6,413,632 B1 * 7/2002 Pascoe et al. ..... 428/364

* cited by examiner

*Primary Examiner*—Joseph L. Perrin
(74) *Attorney, Agent, or Firm*—Terry T. Moyer; Robert M. Lanning

(57) ABSTRACT

A process for forming a spaced dyed yarn, where a yarn is conveyed to a dye application station where a coordinated stream of dye is projected in a normal stream path adjacent to a first side of the yarn. The dye is applied to the yarn when a gas nozzle projects a stream of gas such that it impinges the stream of dye and diverts the stream of dye across said yarn to an alternative deflected path adjacent to the opposite side of said yarn, causing the dye to sweep over the yarn and impact and color the yarn. Upon deactivation of said gas nozzle, the stream of dye passes back across said yarn to the first side of the yarn, impacting and coloring the yarn for a second time.

5 Claims, 8 Drawing Sheets

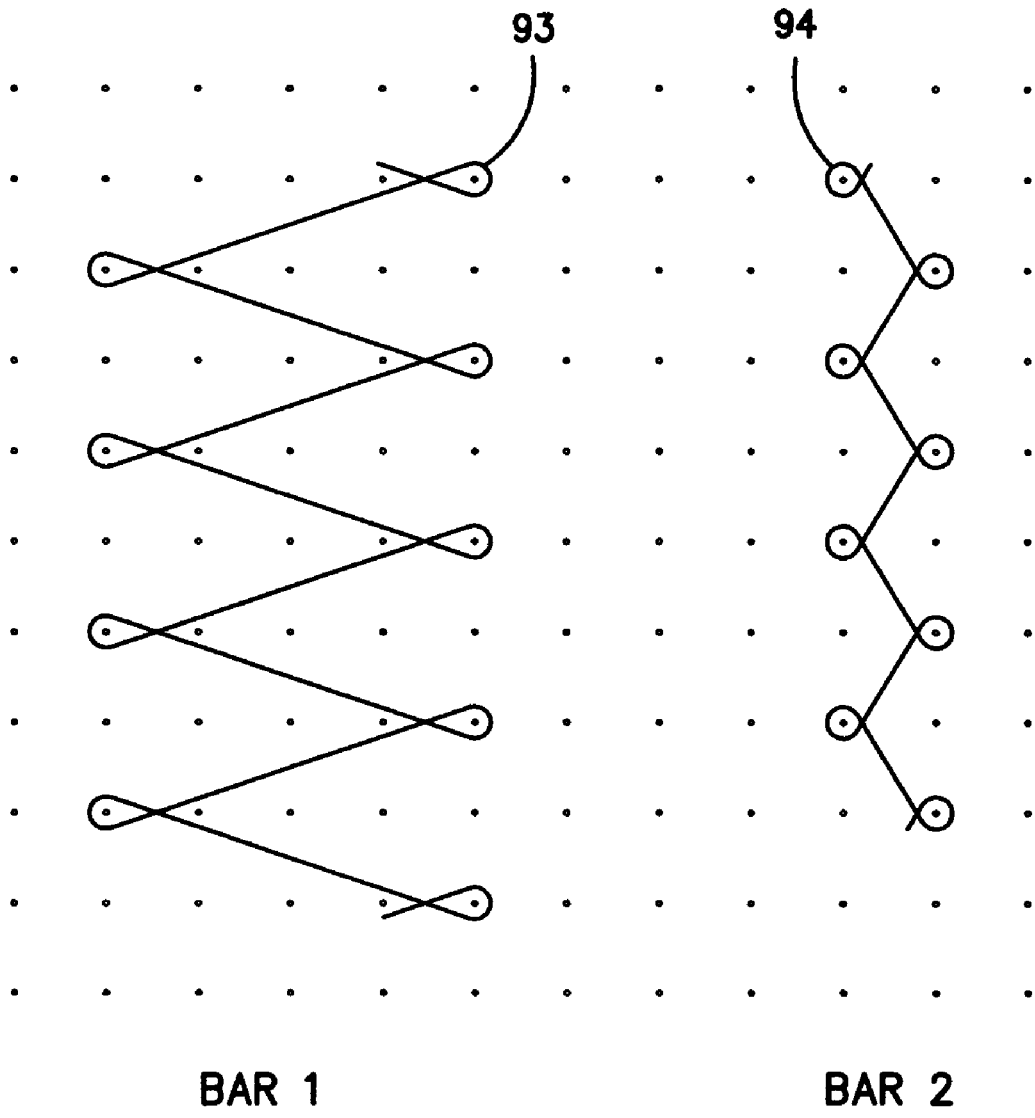
FIG. —9—

APPARATUS AND METHOD FOR FORMING MULTI-COLORED YARN

CROSS-REFERENCE TO RELATED APPLICATIONS

This application is a divisional of prior U.S. application Ser. No. 09/969,854, filed Oct. 2, 2001 now abandoned, entitled "Multi-Colored Yarn and Textile Formed Therefrom", the contents of all of which are incorporated by reference herein in its entirety.

TECHNICAL FIELD

The present invention relates generally to multi-colored yarns and to an improved textile structure of enhanced aesthetic character utilizing multi-colored yarn constituents. More specifically, the invention relates to space dyed yarns and to a textile material formed from a plurality of such yarns at least a portion of which are low denier yarns including short space-dyed color segments along their length. Portions of the color segments are disposed in a discontinuous arrangement at discrete visible locations across an outer face of the textile material without the occurrence of chevrons or other potentially undesirable patterning affects. A method and apparatus for applying the short color segments to the multi-colored yarn constituents are also provided.

BACKGROUND OF THE INVENTION

It is well known to utilize colored yarns within textile materials to impart desired aesthetic characteristics to the textile material. Color is generally imparted to yarns by use of bulk dyeing practices in which a single color is applied to bundles of yarn immersed within a dye bath. Typical dyes as are known to those of skill in the art include disperse dyes, acid dyes and basic dyes. As will be appreciated, upon completion of such a bulk dyeing operation, the dyed yarn is typically of a substantially uniform solid color. Thus, in order to provide a multi-colored appearance to a textile material formed from such bulk dyed yarns, it may be necessary to utilize a number of different colored yarns. However, the utilization of such bulk dyed yarns nonetheless tends to establish visually distinguishable patterns within the resulting textile material which maybe undesirable to some users.

It is also known to utilize so-called "space-dyed" yarns within pile-forming textile materials such as carpeting to provide a random or pseudo-random pattern within the material. One such carpeting material is illustrated and described in U.S. Pat. No. 5,413,832 to Willey the contents of which are incorporated by reference herein.

Several methods are known for space dyeing of yarns so as to impart segments of various colors along the length of such yarns. One such known method is the so-called "knit-deknit" method in which yarns are knit into a construction across which bands of color are introduced. The knit construction is thereafter unraveled so as to yield the lengths of yarn with substantially random coloration patterns disposed along their length. While useful, the "knit-deknit" process may be difficult to control and may be unduly time consuming and complex to enable efficient and cost effective manufacture of large quantities of material.

In order to address the deficiencies of the "knit-deknit" process, several batch-type and continuous processes have been advocated. Among the batch-type processes (in which a predetermined quantity of yarn is treated at one time), it is known to inject yarn packages with a number of different colored dyes to yield a space-dyed product. However, such batch process may be relatively costly and require more product handling than is desired.

As an alternative to the batch-type processes, several types of continuous space-dyeing processes (in which moving yarns are individually or collectively treated) are also known. One such continuous process is illustrated and described in U.S. Pat. No. 5,594,968 to Haselwander et al. the teachings of which are incorporated by reference herein. In this process yarns are intermittently pressed against dye applicator rolls to impart segments of dye to the yarns in a predetermined order. The yarn is held against the dye applicator rolls by a pattern roll supporting deflecting rods or paddles arranged in spaced relation at the surface of the pattern roll up stream of the dye applicator roll so as to provide a defined period of contact between the yarn and the dye applicator roll as the deflecting elements are pressed against the yarn at locations adjacent to the dye applicator rolls. Based upon claims made in available advertising literature, such a system is believed to permit the application of a controlled pattern of different colors to yarn having a linear density of about 500 to about 5000 denier and the length of the individual color segments achievable in such an apparatus is believed to be in the range of at least 0.5 inches (12.7 mm) or more.

U.S. Pat. Nos. 5,491,858 and 5,557,953 to Massotte et al. (incorporated by reference) disclose equipment and procedures for applying dye segments to yarns using spinning disk elements having spaced openings which permit passage of dye droplets towards the yarns when the disk openings and yarns are in opposing relation to one another. Such arrangements have been promoted as providing short color segments, but are believed to be useful only with relatively large yarns having linear densities in the range of about 720 denier and greater. As will be appreciated, such high denier materials provide an enlarged impact target area and are thus more likely to be contacted by a sufficient number of the disperse dye droplets emerging from the spinning disks to effect coloration at a desired localized position. Conversely, such disperse droplets may tend to miss smaller diameter yarns.

Another continuous process is illustrated and disclosed in U.S. Pat. No. 6,019,799 to Brown et al. the teachings of which are incorporated by reference herein. The process disclosed therein utilizes a substantially direct application of a spray pattern of dye liquor droplets towards a yarn sheet. The dye stream is cycled on and off to apply a desired patterning effect. Such a process may be useful in applying dye segments to low denier yarns but the color segments applied are relatively long being in the range of about 2 inches (50.8 mm) or greater.

In view of the above, the prior art has recognized a number of techniques for forming space-dyed yarns. However in order to obtain relatively short color segments of less than about 2 inches (50.8 mm), the yarns have been characterized by relatively high linear density ratings of 500 denier or greater. Moreover, in order to obtain color segments of less than 0.5 inches (12.7 mm), the yarns have been required to have even higher linear densities of at least about 720 denier or greater.

SUMMARY OF THE INVENTION

The present invention provides advantages and alternatives over the prior art by providing space-dyed yarns incorporating discrete color segments which may have lengths less than about 2 inches (50.8 mm) while nonetheless being characterized by virtually any linear density including linear densities substantially less than about 500 denier. Textile materials incorporating such space-dyed yarns as well as processes and equipment for manufacturing such space-dyed yarns are also provided.

In accordance with one aspect of the present invention, a multi-colored yarn is provided including a plurality of discrete color segments arranged in predefined spaced relation along the length of the yarn. The yarn may have a linear density less than about 500 denier and at least a portion of the color segments may be of a controlled length less than about 2 inches (50.8 mm).

In accordance with another aspect of the present invention, a textile material is provided which includes a plurality of space-dyed yarns within a cohesive knit or woven construction. The space-dyed yarns are of relatively low linear density in the range of about 500 denier per yarn or less and include a multiplicity of discrete color segments arranged along the length of the yarn. A portion of the color segments are of finite lengths in the range of less than about 2 inches (50.8 mm). The short length of the color segments results in portions of the discrete color segments forming disperse color spots at discrete visible locations across an outer face of the textile material. The relatively low linear density of the yarns forming the textile material provides a desirable tactile character while permitting the textile material to have a relatively low mass per unit area which is preferably in the range of about 8 to about 22 ounces per square yard (about 271 to about 746 grams per square meter).

BRIEF DESCRIPTION OF THE DRAWINGS

The present invention will now be described by way of example only, with reference to the accompanying drawings which constitute a part of the specification herein and in which;

FIG. 9 is a needle bar diagram illustrating an exemplary construction for forming a warp knit fabric using low denier colored yarns.

While the invention is illustrated and will be described in connection with certain potentially preferred embodiments, procedures and practices, it is to be understood that in no event is the invention to be limited to such illustrated and described embodiments, procedures and practices. On the contrary, it is intended that the present invention shall extend to all alternatives and modifications as may embrace the principles of this invention within the true spirit and scope thereof.

DESCRIPTION OF THE PREFERRED EMBODIMENTS

Figure 1:
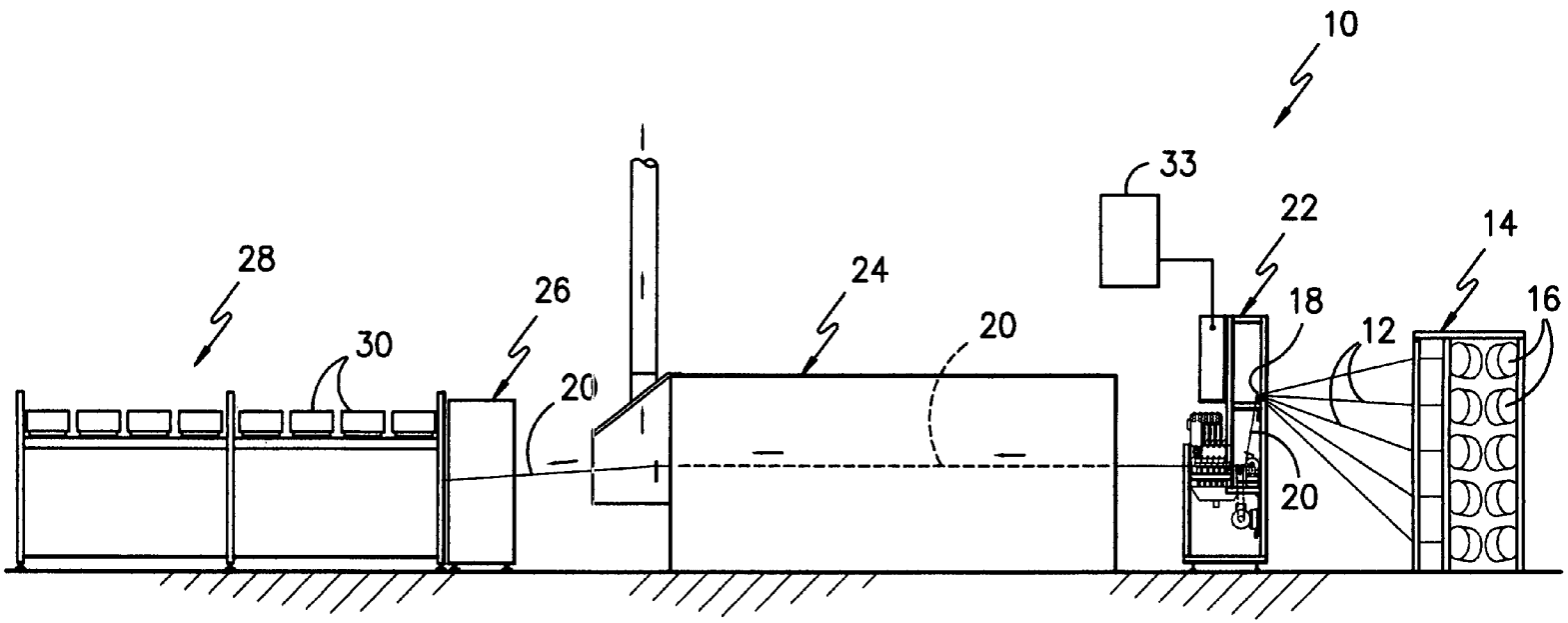
FIG. 1 is a side view of a space dyeing range for applying and fixing short dye segments along a yarn.

Reference will now be made to the drawings, wherein to the extent possible like reference numerals are utilized to designate like components throughout the various views. FIG. 1 shows a space dyeing range 10 for use in applying and fixing dye to a plurality of yarns 12. As illustrated, the range 10 preferably includes a creel 14 which holds a multiplicity of yarn packages 16. Individual yarns 12 from each package 16 are passed through a first comb 18 wherein the yarns 12 are arranged in a substantially uniformly spaced, parallel fashion so that the yarns 12 do not overlap and are properly spaced in side to side relation to form a yarn sheet 20. The yarn sheet 20 passes through a dye applicator 22 for application of patterned color segments in a predefined arrangement along the yarns 12 in a manner to be described further hereinafter. After dyeing, the yarn sheet 20 exits the dye applicator 22 and passes through a drying oven 24 as will be well known to those of skill in the art. After exiting the drying oven 24 the yarn sheet 20 enters a yarn inspection system 26 to detect any breakage of the individual yarns 12. The yarns 12 are then wound by a winder 28 into packages 30. The packages 30 of dyed yarn are later fixed by an appropriate method such as by autoclaving, then washed to remove any excess, unfixed dye and dispersing agent. The yarn is thereafter dried and transported to an apparatus such as a weaving or knitting machine for formation into a cohesive textile construction.

Figure 2:
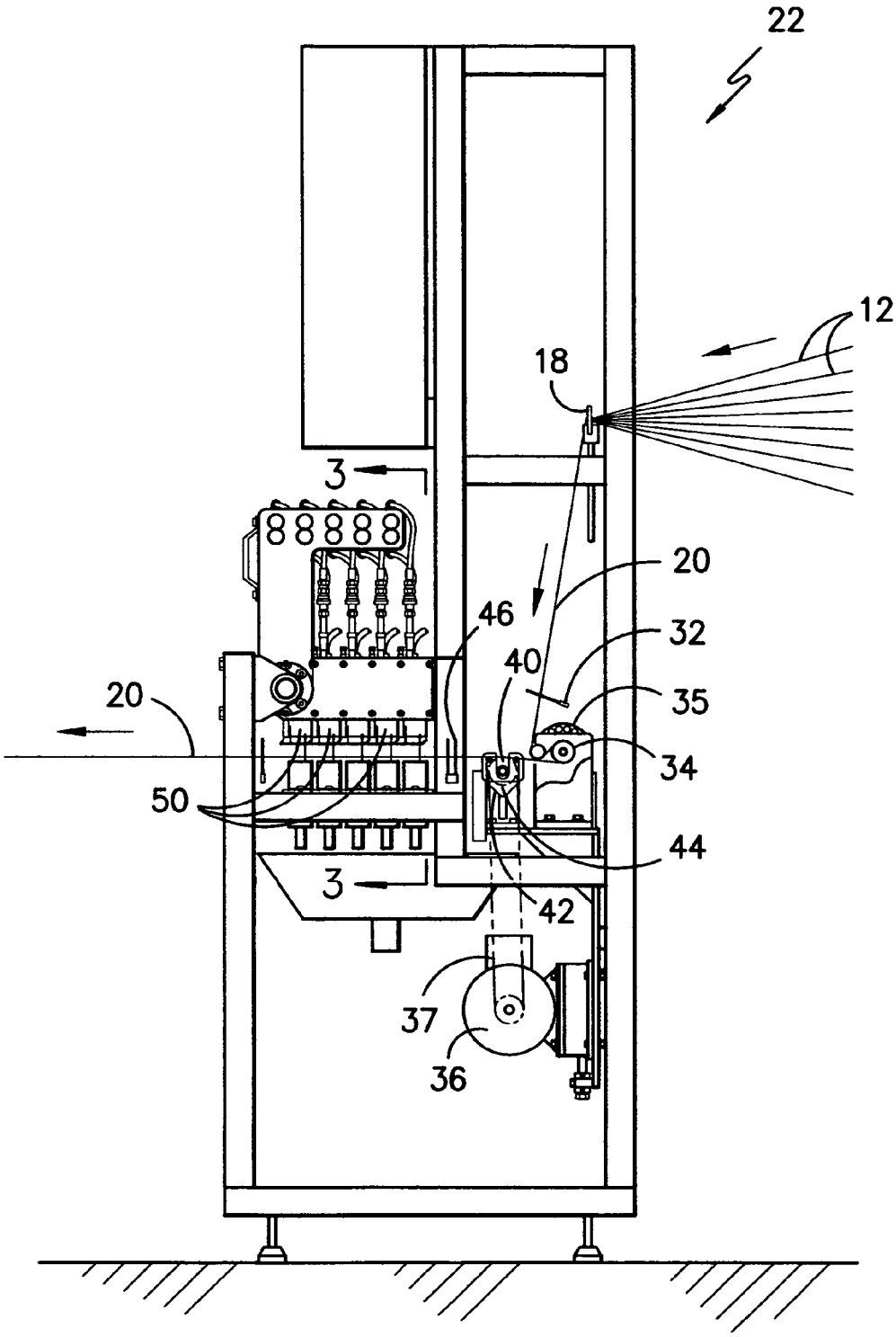
FIG. 2 is a cutaway side view of a dye application unit within the space dyeing range for applying dye segments to a yarn.

Turning to FIG. 2, within the dye applicator 22 the yarn sheet 20 passes through a second comb 32 and loops around an indexing roll 34. An encoder 35 linked in communication with the indexing roll 34 monitors the progression of the yarn sheet 20 and communicates such data to an operating computer 33 (FIG. 1) which has been programmed to control the application of a sequence of color segments at predefined locations along the yarns 12 within the yarn sheet 20 in a manner as will be described further hereinafter.

As illustrated, upon exiting the indexing roll 34 the yarn sheet 20 is passed over a dye application roll 40. The dye application roll 40 may be rotated by a motor 36 via a drive belt 37. Of course, other drive assemblies as will be known to those of skill in the art may also be utilized. As shown, the dye application roll is mounted in rotating relation within a dye trough 42. The dye application roll 40 is partially submerged within a reservoir of dye liquor 44 such that upon rotation of the dye application roll 40 by the motor 36, the dye liquor 44 is spread across the contacting yarn sheet 20 so as to apply a first uniform base shade along the length of the yarns 12 within the yarn sheet 20. As will be discussed further hereinafter, the base shade may be used to establish colored segments along the length of the yarns 12. Of course, in the event that the desired base shade is white, then no dye liquor 44 need be applied to the yarn sheet 20. Upon exiting the dye application roll 40 the yarn sheet 20 is passed through a third comb 46 and towards a series of dye stream application stations 50 each of which may apply a different colored dye to the yarn sheet 20 in a successive pattern.

Figure 3:
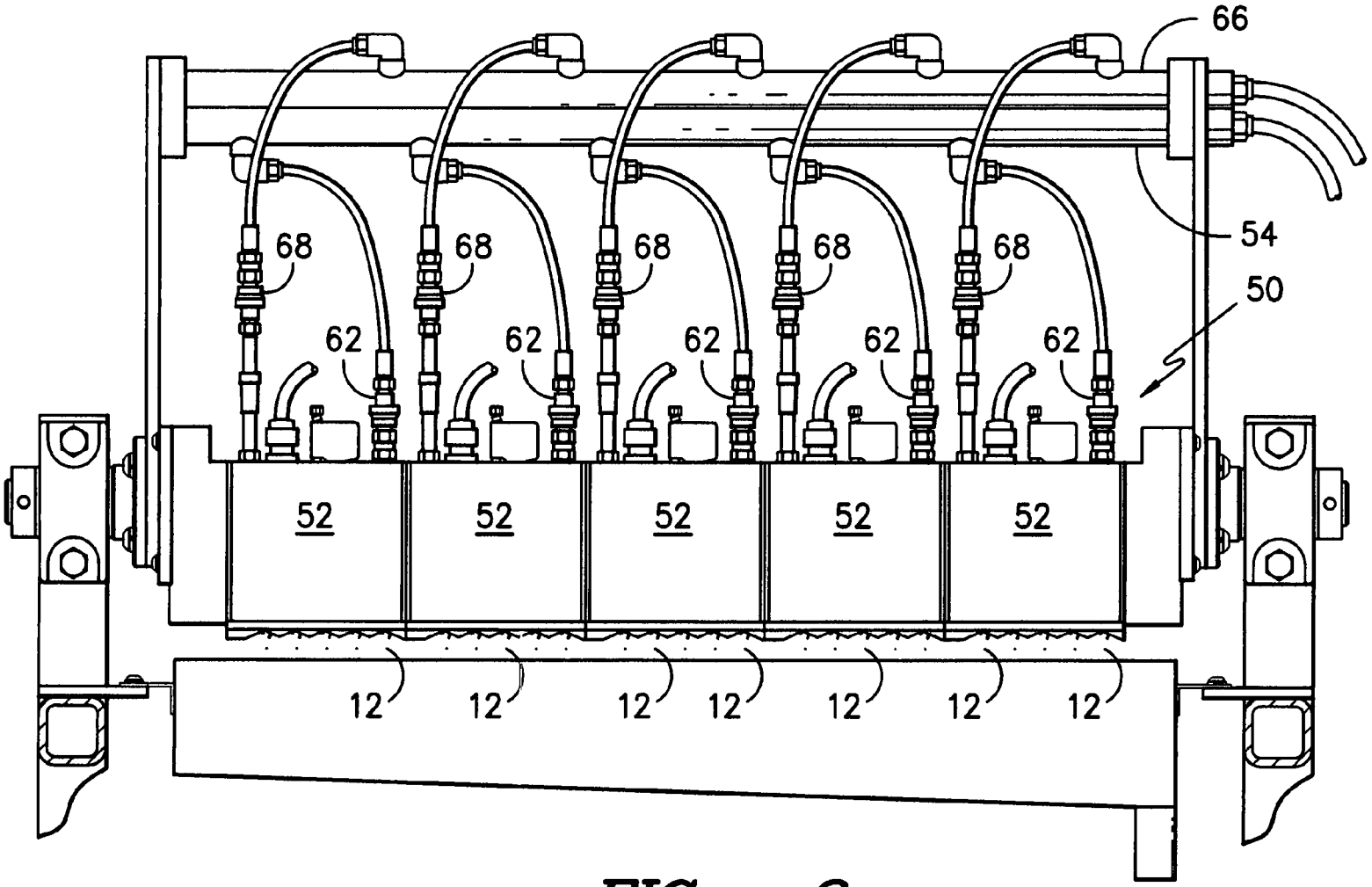
FIG. 3 is a view taken along line 3—3 in FIG. 2 illustrating an arrangement of dye application modules in opposing relation to a yarn sheet.

As illustrated in FIG. 3, the dye stream application stations 50 are disposed substantially transverse to the travel path of the yarns 12 forming the yarn sheet 20. As shown, each of the dye stream application stations 50 preferably includes a multiplicity of dye stream application modules 52 to apply dye streams to a number of opposing yarns 12. According to the illustrated and potentially preferred practice, each of the dye stream application modules 52 is preferably substantially identical in configuration and is linked to a common dye feed source 54 such that each dye stream application module 52 applies the same color across the width of the yarn sheet 20. Of course, one or more modules may be fed by an alternative dye feed source if desired such that different colors are applied across the width of the yarn sheet 20.

Figure 4:
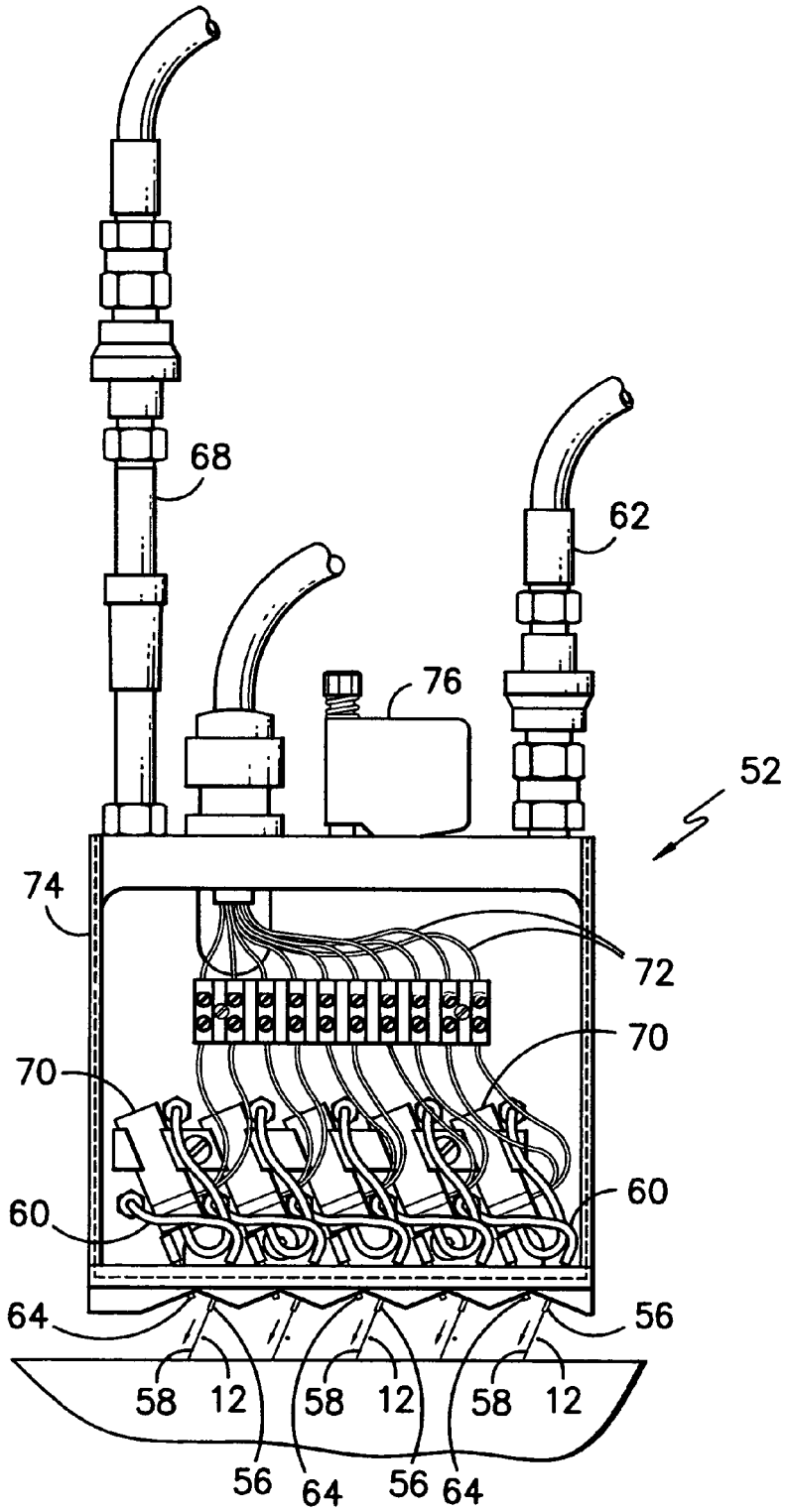
FIG. 4 is a partially cutaway view of a dye application module incorporating a multiplicity of color applying dye nozzles and gas nozzles for projection of interrupting gas jets.
Figure 5:
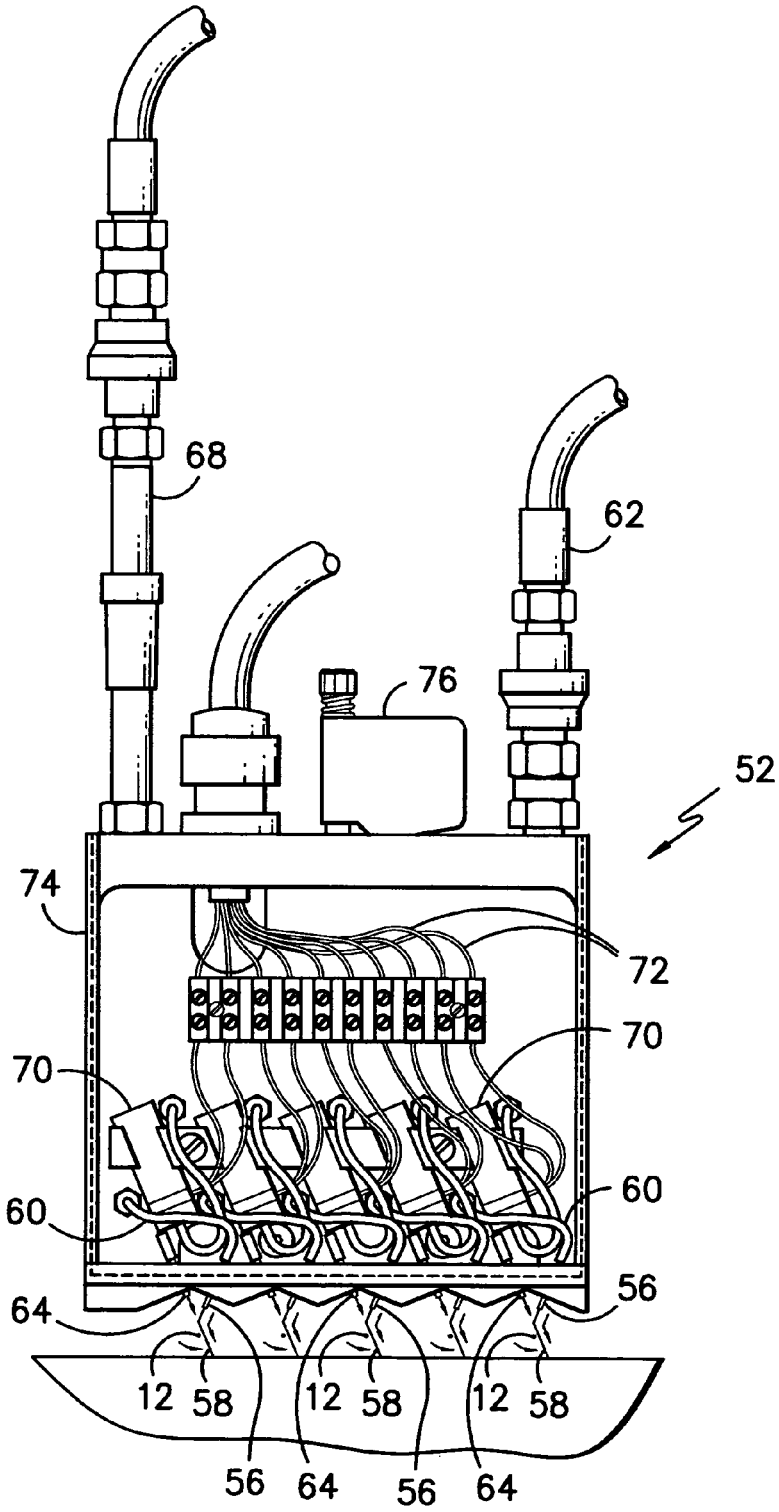
FIG. 5 is a view similar to FIG. 4 upon activation of the interrupting gas jets.

Referring now simultaneously to FIGS. 4 and 5, one practice for the application of dye segments along individual yarns 12 is illustrated. As shown, the dye stream application modules 52 each include a multiplicity of dye nozzles 56 projecting in angled relation towards the yarn sheet 20. The dye nozzles are arranged so as to discharge a narrow stable dye stream 58 to the side of the individual yarns 12 such that under normal conditions there is no interaction between the dye stream 58 and the yarns 12. According to the potentially preferred practice, each of the dye nozzles 56 has an outer diameter of about 0.065 mm with an inner diameter of about 0.033 mm and is operated at a fluid pressure of about 0.5 psi to about 1.5 psi (about 0.035 to about 0.105 Kg force per square cm). Each of the dye nozzles 56 is preferably connected via tubing 60 to the common pressurized dye feed source 54 (FIG. 3) by a dye inlet 62. Thus, each of the dye nozzles 56 preferably transmits a dye stream 58 of substantially the same character.

In order to apply discrete short color segments to the individual yarns 12, the illustrated dye stream application module 52 includes a multiplicity of gas nozzles 64 having an outer diameter of about 0.083 mm with an inner diameter of about 0.049 connected to a pressurized gas source 66 such as instrument quality air or nitrogen at a pressure of about 12 to about 15 psi (about 0.84 to about 1.05 Kg force per square cm) via an air line 68. Gas flow through the nozzles 64 is cycled on and off in a predetermined programmed manner by fast acting valves 70 such as valve model LFAX0512000BA which is believed to be available from the Lee Company having a place of business in Westbrooke, Conn. USA. The valves 70 are preferably controlled by the operating computer 33. In this regard, it is contemplated that the valves 70 may be operated either in unison or individually via control signals carried by transmission lines 72 linked to the operating computer 33 or other control device such as a programmable logic controller or the like as may be known to those of skill in the art.

In operation, the dye stream application module 52 is preferably enclosed within a box-like frame structure 74. A latch structure 76 may be used to remove a face panel to gain access to the valves 70 and other components within the interior of the dye stream application module 52 to facilitate maintenance and adjustment as may be desired.

As best illustrated in FIG. 5, upon opening of one or more of the valves 70, a gas impingement jet is projected through the gas nozzles 64 and into contact with the dye stream 58. As shown, the jet exiting the gas nozzles 64 intercepts the dye stream 58 at a position above the plane of the yarn sheet 20 thereby deflecting the dye stream 58 away from its normal path on one side of an opposing yarn 12 as shown in FIG. 4 and into an alternative deflected path adjacent the opposite side of the same yarn 12 as illustrated in FIG. 5. During this transition, the dye stream 58 is caused to sweep across the adjacent yarn 12 in the direction indicated by the arrows in FIG. 5 until the lower portion of the dye stream 58 is in general alignment with the gas nozzles 64 causing the deflection. As will be appreciated, during the deflection process, the dye stream 58 applies a short band of color across the yarns 12. Likewise, when the flow of impinging gas is terminated from the gas nozzles 64, the dye stream 58 resumes its normal flow path as shown in FIG. 4. During this recovery, another short segment of dye is again applied across the yarns 12. The intermittent activation and deactivation of the valves 70 provides for short disperse spots of color with lengths as short as about 1 mm or less along the length of the yarns 12. This process may be repeated at each of the dye application stations 50 along the travel path of the yarn sheet 20 so as to apply virtually any arrangement of colors along the length of the yarns 12. The result is a yarn 12 having an arrangement of color bands disposed in a predetermined arrangement wherein the color bands may have controlled short lengths even if the yarn 12 has a low denier rating.

Figure 6:
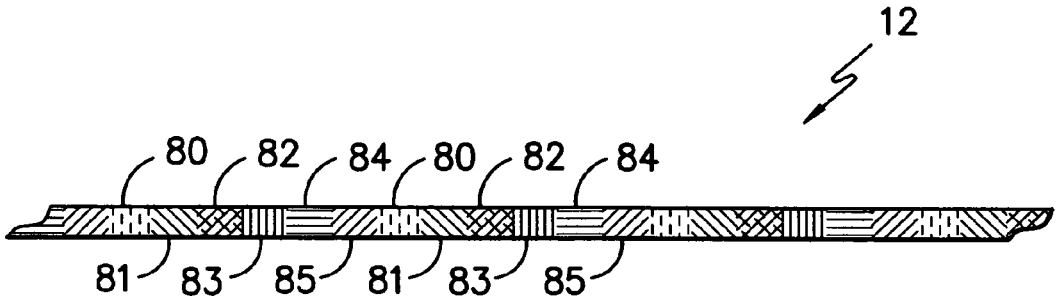
FIG. 6 illustrates an arrangement of color segments along a yarn as may be applied by the dye application unit illustrated in FIG. 2.

By way of example only, and not limitation, an arrangement of colors as may be applied along a yarn 12 within the dye applicator 22 incorporating five dye stream application stations 50 is shown in FIG. 6. As illustrated, the yarn 12 includes six substantially discrete color segments 80, 81, 82, 83, 84 and 85 corresponding to a base shade applied at the dye application roll 40 and five colors applied at the dye stream application stations 50. Of course, any other number of color segments may be applied by increasing or decreasing the number of dye application stations.

As indicated, the length of the color segments 80–85 may be highly variable depending upon the desired pattern. However, according to the potentially preferred practice, the lengths of a substantial portion of the color segments 80–85 are preferably less than about 2 inches (50.8 mm) and will more preferably be less than about 0.5 inches (12.7 mm) and are most preferably about 1 mm to about 10 mm. It is believed that such short color segments may be beneficial in the development of a substantially diverse seemingly random color arrangement across the surface of a textile material incorporating low denier yarns. In order to avoid streaks or patterning, it is contemplated that preferably a substantial portion and more preferably at least about 50% or more of the color segments 80–85 within the yarn 12 making up the formed textile are of lengths less than about 2 inches (50.8 mm). At least some percentage of the color segments (up to 100%) may be of even shorter length in the range of 1 mm to about 12.5 mm.

Surprisingly, it is possible to produce multicolored yarns 12 spanning a large range of constructions and linear densities. In particular, it has been found that yarns 12 incorporating the potentially desirable short color segments may have a broad range of linear densities making them useful in a broad range of applications. By way of example, the yarn 12 may have a linear density of about 500 denier or less and more preferably has a linear density of about 70 denier to about 250 denier and most preferably has a linear density of about 150 denier. One potentially preferred yarn 12 is a single ply 150 denier continuous filament polyester yarn having 34 filaments per yarn. Another exemplary yarn is a single ply 70 denier continuous filament yarn having 36 filaments per yarn. Still another exemplary yarn is a 2 ply 250 denier continuous filament polyester yarn having 100 filaments per yarn. It is also contemplated that spun yarn constructions of such low deniers as well as yarns of substantially greater denier and/or of different materials such as nylon may be utilized if desired.

It is to be appreciated that while the color segments extending along the yarn 12 may be extremely short, it is also contemplated that much longer color segments may also be applied. Such extended color segments which may be virtually infinite in length may be formed by rapidly cycling the valves 70 on and off so as to cause the dye stream to undergo sweeping deflection and recovery at a rate such that there is no visible gap between segments of applied dye. This capability permits one to impart dye segments of virtually any length as may be desired. The ability to impart extended lengths of dye to the yarn 12 is useful in both space-dyeing as well as in solid shade dyeing of a wide array of yarn types including yarns without good wicking characteristics such as untextured hard yarns or so called "partially oriented yarns" which have heretofore been difficult to dye with uniformity in traditional package dye processes and have relied upon solution dyeing the polymer from which such yarns are formed. Thus, the techniques as described herein may be used to impart both discrete or substantially extended lengths of color to such yarns as may be desired. Of course virtually any other yarn type may also be dyed as well.

It is contemplated that aside from imparting both short and long color segments to the yarn 12, the dye applicator 22 may be utilized to carry out selected color blending on the yarns 12. By way of example only and not limitation, it is contemplated that such color blending may be carried out by using one or more of the later encountered dye stream application stations 50 to apply dye over dye segments previously applied by one or more dye stream application stations 50 located upstream. As will be appreciated, upon the occurrence of such blending a colored segment is produced representing the dye mixture at the location of blending. Of course, since the number of dye stream application stations 50 is in no way limited, virtually any number of overdying operations may take place to produce an infinite number of color options. The length of the overdyed color segments so produced may be as short as about 1 mm to an infinite length corresponding to the entire length of the yarn 12.

It is contemplated that the yarns 12 may be formed into a number of fabric constructions including relatively light weight constructions useful in a number of applications. According to one potentially preferred practice, short color segments 80–85 provide seemingly randomly disperse spots of color across an outer face surface of the formed textile material. Such random coloration supplies a surprisingly attractive appearance while the relatively low linear density of the yarns 12 permits the formation of relatively light weight materials.

Figure 7:
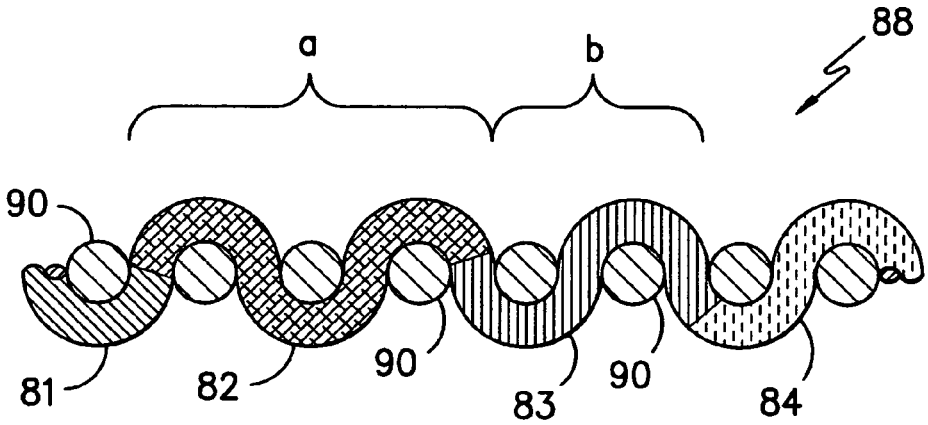
FIG. 7 illustrates a simplified woven construction incorporating the colored yarn arrangement of FIG. 6.

As illustrated in FIG. 7, according to one embodiment the yarn 12 may be formed into a woven textile fabric 88 wherein yarn 12 incorporating short color segments 80–85 runs in a weft direction in interwoven relation to a multiplicity of warp yarns 90. Of course, it is also contemplated that the yarn 12 incorporating the color segments 80–85 may also run in the warp direction if desired. The woven textile fabric 88 may be formed by weaving practices as will be well known to those of skill in the art including plain weaving, dobbie weaving and jacquard weaving, although dobbie and jacquard weaving may potentially be preferred.

According to one potentially preferred practice, the yarn 12 incorporating the short color segments 80–85 makes up not more than about 40% by weight of the woven textile fabric 88 and preferably make up about 5%–35% by weight. In one exemplary construction, the woven textile fabric has a weave density of about 35 to about 130 warp ends per inch (preferably about 40 to about 125 warp ends per inch) and about 25 to about 60 weft yarns per inch (preferably about 30 to about 54 weft yarns per inch) wherein all yarns have a linear density of about 70 to about 150 denier. The resulting woven textile fabric 88 preferably has a mass per unit area in the range of about 9 to about 20 ounces per square yard (about 305 to about 679 grams per square meter) thereby facilitating use in a number of applications such as automotive seat coverings and the like wherein substantial weight may be undesirable. The warp yarns 90 may be of either the same or different physical construction from the yarns 12 incorporating the color segments 80–85.

As previously indicated, the short color segments 80–85 along the length of the yarn 12 provide short discontinuous points of color across the surface of the woven textile fabric 88. Thus, in the illustrative construction illustrated in FIG. 7, the segment of color 82 is visible across a short distance "a" spanning two knuckles across the fabric surface while the adjacent color segment 83 is visible across a distance "b" spanning a single knuckle. Of course the scale of such distances is greatly enhanced for illustrative purposes and in practice the distances "a" and "b" will appear as substantially discrete points of color within the overall structure of the woven textile fabric 88. These discrete points of color have been found not to form coordinated visible patterns such as chevrons or the like across the surface of the fabric 88 while nonetheless providing potentially pleasing coloration. Moreover, it has been surprisingly found that the percentage of yarn 12 incorporating the color segments 80–85 which is necessary to impart desired aesthetic coloration may be extremely low. As indicated, it is contemplated that a woven textile fabric 88 preferably incorporates no more than about 40% by weight of such colored yarn 12 and preferably incorporates about 5 to about 35% by weight of such colored yarn 12. It is believed that the short color segments 80–85 facilitate the use of such low percentages due to the fact that the disperse discrete spots of color provide a user with a visual perception of an enhanced level of coloration even at such low percentages.

Aside from woven constructions, it is also contemplated that the yarn 12 including the discrete color segments 80–85 may be utilized in knit fabric constructions. In particular, it is contemplated that the yarn 12 may make up a portion of the yarn forming the face of such a knit fabric. By way of example only and not limitation, a needle-point diagram illustrating the construction of a double needle bar plush knit fabric is illustrated in FIG. 6. The illustrated pattern is used to form a 6 bar double needle bar warp knit fabric which may be slit to yield a short fiber length pile surface. In such a construction a ground yarn 90 is disposed at Bar 1 and Bar 6, a tie yarn 91 is disposed at Bar 2 and Bar 5 and cooperating face yarns 92 are disposed at Bar 3 and Bar 4. The yarn 12 including the discrete color segments 80–85 makes up at least a portion of the face yarns at Bar 3 and Bar 4 so as to impart face coloration. In one potentially preferred construction the ground yarn 90 and the tie yarn 91 are single ply 70 denier continuous filament polyester yarn with about 36 filaments per yarn although virtually any other suitable yarn as may be known to those of skill in the art may also be utilized as the ground yarn 90 and tie yarn 91. The face yarns are preferably single ply 150 denier continuous filament polyester having 34 filaments per yarn although virtually any other suitable yarn as may be known to those of skill in the art may also be utilized at the face. By way of example only, one alternative face yarn 92 which may be utilized at the face is a 250 denier continuous filament polyester having 100 filaments per yarn.

Figure 8:
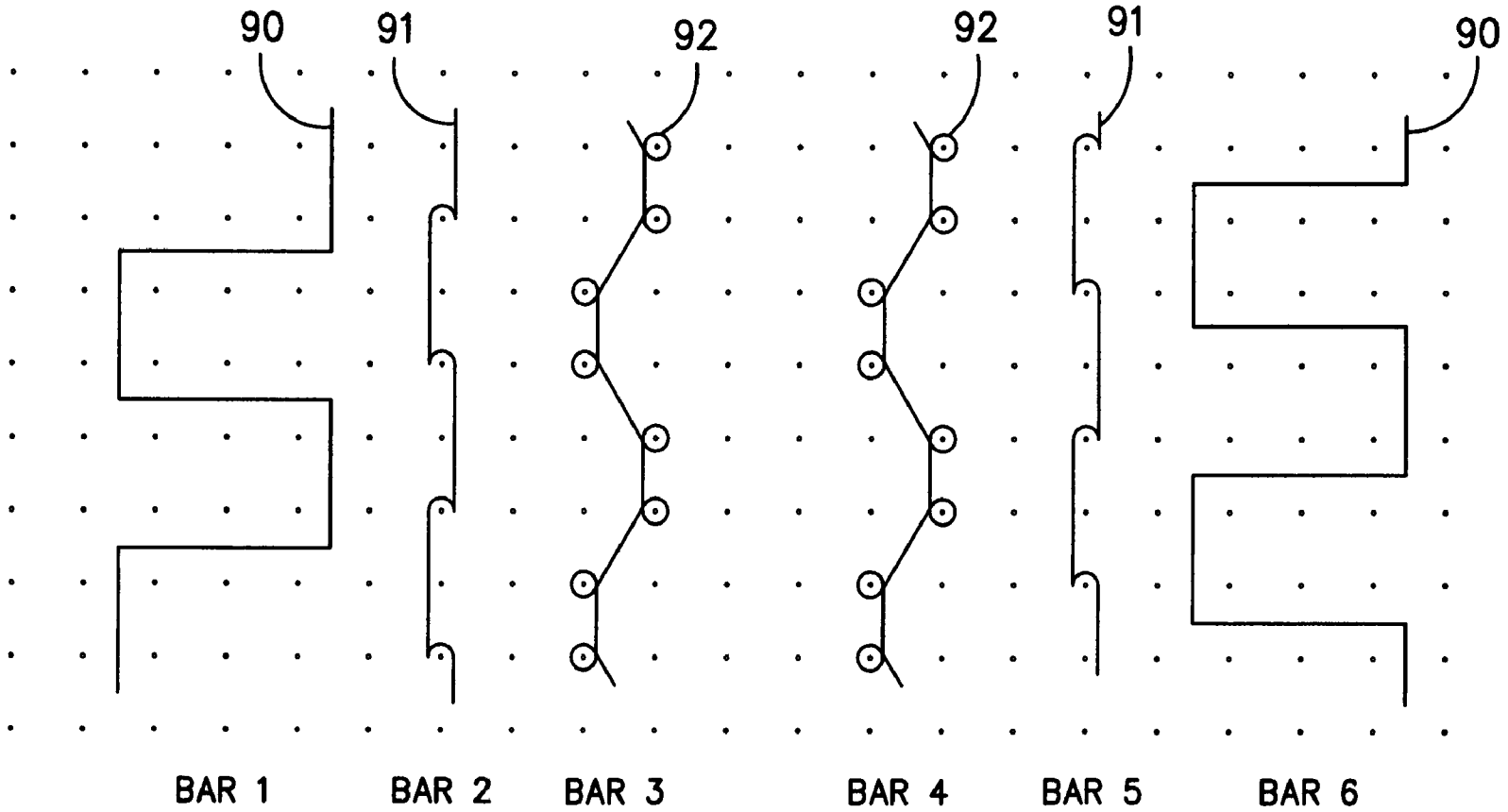
FIG. 8 is a needle bar diagram illustrating an exemplary construction for forming a plush double needle bar knit fabric using low denier colored yarns.

By way of example only, it is contemplated that a construction as illustrated in FIG. 8 may be formed on well known knitting equipment such as 32 gauge or 44 gauge double needle bar machines. As with the woven textile woven fabric 88, the use of yarns 12 incorporating short color lengths provides an arrangement of substantially discrete discontinuous points of color across the finished fabric. While the space dyed yarns 12 incorporating the short color segments as described above may make up any percentage of the final fabric, such yarns are preferably located preferentially at the face and make up not more than about 40% by weight of the final fabric and most preferably make up in the range of about 5% to about 35% by weight of the fabric.

The utilization of the low denier yarns provides the ability to form relatively tight weight knit fabric constructions. By way of example, in a 32 gauge construction the fabrics formed using the 150 denier face yarn with 70 denier ground yarns and tie yarns typically has about 20 to about 26 courses per inch and about 17 wales per inch with a fabric weight of about 9 to about 12 ounces per square yard (about 305 to about 407 grams per square meter). In a 44 gauge construction, the double needle bar knit fabrics typically have about 25 to about 30 courses per inch with about 25 wales per inch and a fabric weight of about 9 to 16 ounces per square yard (about 305 to about 542.5 grams per square meter).

It is to be appreciated that the yarn 12 incorporating the short color segments as described above may also be formed into a number of other knit constructions. By way of example only, it is contemplated that a relatively low denier yarn such as a single ply 70 denier or 150 denier continuous filament polyester yarn may be knitted on a knitting machine in a two to four bar construction. The surface of the fabric may thereafter be napped by a wire wheel, sander or other abrasive element as will be known to those of skill in the art to raise a textured pile surface thereby forming a so-called "nap knit" construction. The yarns 12 incorporating the color segments 80–85 preferably make up only about 5 to about 35 weight percent of the fabric in this construction.

One exemplary two bar warp knit construction pattern suitable for the formation of a nap knit fabric is illustrated in FIG. 9. In such a construction the Bar 1 yarn 93 and Bar 2 yarn 94 are each preferably a single ply continuous filament polyester yarn having a linear density in the range of about 70 denier to about 500 denier. Lower denier ratings in the range of about 70 denier to about 250 denier may be preferred for some applications. One exemplary nap knit construction utilizing a 150 denier polyester continuous filament yarn with 34 filaments per yarn yields a knit construction having about 33 courses per inch and about 25 wales per inch with a fabric weight in the range of about 9 to 10 ounces per square yard (about 305 to about 339 grams per square meter). Lower denier yarns such as the single ply 70 denier continuous filament polyester yarn with about 36 filaments per yarn may be utilized in even finer structures such as may be formed on 56 gauge knitting machines. Of course, virtually any other fabric construction such as circular knits or the like may also be formed if desired.

It is to be understood that while the present invention has been illustrated and described in relation to certain potentially preferred embodiments, constructions, and procedures, that such embodiments, constructions and procedures are illustrative only and that the present invention is in no event to be limited thereto. Rather, it is contemplated that modifications and variations embodying the principles of the invention will no doubt occur to those of skill in the art. It is therefore contemplated and intended that the present invention shall extend to all such modifications and variations as may incorporate the broad aspects of the invention within the full spirit of scope thereof.

That which is claimed is:

1. A process for applying dye to a yarn, the yarn having a first side and a second side opposite the first side, the process comprising:

conveying said yarn to at least a first dye application station;

delivering a coherent stream of dye from said dye station in a normal stream path adjacent to and in non-contacting relation with the first side of said yarn; and intermittently activating and deactivating a gas nozzle projecting towards said coherent stream of dye such that upon activation of said gas nozzle, a stream of gas impinges said coherent stream of dye thereby diverting said coherent stream of dye across said yarn to an alternative deflected path adjacent to and in non-contacting relation with the second side of said yarn, whereby said dye impacts said yarn in a coherent stream and colors said yarn and such that upon deactivation of said gas nozzle, the coherent stream of dye passes back across said yarn whereby said dye impacts said yarn in a coherent stream and colors said yarn.

2. The process as recited in claim 1, wherein the gas nozzle is repeatedly activated and deactivated over a prolonged period and wherein the period between activation and deactivation is sufficiently short such that a substantially uninterrupted dyed segment is produced along the yarn.

3. The process as recited in claim 1, wherein a period of time elapses between activation and deactivation of the gas nozzle such that a pattern of separate dye segments is produced along the yarn.

4. The process as recited in claim 1 further comprising delivering the yarn to a second dye application station downstream of said first dye application station, whereat a second coherent stream of dye is delivered along a normal stream path adjacent to and in non-contacting relation with the first side of said yarn, said second dye application station including an intermittently activatable gas nozzle projecting towards said second coherent stream of dye such that upon activation of said gas nozzle, a stream of gas impinges said second coherent stream of dye thereby diverting said second coherent stream of dye across said yarn to an alternative deflected path adjacent to and in non-contacting relation with the second side of said yarn, whereby said dye from the second dye application station impacts said yarn in a coherent stream and colors said yarn and such that upon deactivation of said gas nozzle, the second coherent stream of dye passes back across said yarn whereby said dye from the second dye application station impacts said yarn in a coherent stream and colors said yarn.

5. The process as recited in claim 4, wherein at least a portion of the dye from the second dye application station impacts and colors said yarn at locations along said yarn previously colored by dye from said first dye application station such that dye from said first dye application station and from said second dye application station is intermixed at said locations along said yarn whereby mixed coloration is achieved.

* * * * *